US008031078B1

(12) United States Patent
Liestman

(10) Patent No.: US 8,031,078 B1
(45) Date of Patent: Oct. 4, 2011

(54) KEY CHAIN HOLDER WITH CLOCK AND ALARM

(76) Inventor: Richard E. Liestman, Glencoe, MN (US)

( * ) Notice: Subject to any disclaimer, the term of this patent is extended or adjusted under 35 U.S.C. 154(b) by 439 days.

(21) Appl. No.: 12/203,678

(22) Filed: Sep. 3, 2008

(51) Int. Cl.
*G08B 13/00* (2006.01)

(52) U.S. Cl. ..... 340/574; 340/573.4; 340/573.1; 340/693.5

(58) Field of Classification Search ..... 340/574
See application file for complete search history.

(56) References Cited

U.S. PATENT DOCUMENTS

| | | | | | |
|---|---|---|---|---|---|
| 2,386,711 | A | * | 10/1945 | Parker | 116/67 R |
| 2,690,729 | A | * | 10/1954 | Maier | 116/112 |
| 2,782,748 | A | * | 2/1957 | Zegarowitz | 116/112 |
| 4,223,804 | A | * | 9/1980 | Morris et al. | 222/3 |
| D260,008 | S | | 7/1981 | Wistrand | |
| 4,449,474 | A | * | 5/1984 | Mariol | 116/2 |
| 4,633,232 | A | * | 12/1986 | Nelson et al. | 340/542 |
| 4,810,996 | A | * | 3/1989 | Glen et al. | 340/321 |
| 5,032,824 | A | * | 7/1991 | Corbin | 340/574 |
| 5,075,671 | A | * | 12/1991 | Livingston, III | 340/574 |
| 5,193,048 | A | * | 3/1993 | Kaufman et al. | 361/232 |
| 5,258,746 | A | * | 11/1993 | Leitten et al. | 340/574 |
| 5,274,358 | A | * | 12/1993 | Janis | 340/574 |
| 5,317,305 | A | * | 5/1994 | Campman | 340/573.1 |
| 5,429,301 | A | * | 7/1995 | Franks | 239/1 |
| 5,455,566 | A | * | 10/1995 | Conway | 340/573.1 |
| 5,461,366 | A | * | 10/1995 | Figuereo et al. | 340/574 |
| 5,587,970 | A | * | 12/1996 | Greenwood | 368/10 |
| 5,629,679 | A | * | 5/1997 | Cranford et al. | 340/574 |
| 5,638,767 | A | * | 6/1997 | Bush | 116/139 |
| 5,644,297 | A | * | 7/1997 | Masi et al. | 340/573.1 |
| 5,673,819 | A | * | 10/1997 | Brunswig | 222/113 |
| 5,893,483 | A | * | 4/1999 | Duran | 222/39 |
| 6,052,052 | A | | 4/2000 | Delmonaco | |
| 6,239,704 | B1 | | 5/2001 | Olson | |
| 6,262,665 | B1 | * | 7/2001 | Eskander | 340/573.1 |
| 6,310,539 | B1 | * | 10/2001 | Rye et al. | 340/321 |
| 6,439,432 | B1 | * | 8/2002 | Park | 222/113 |
| 6,441,731 | B1 | | 8/2002 | Hess | |
| D511,984 | S | | 11/2005 | Kumagai | |
| 6,980,105 | B2 | | 12/2005 | Hodgen | |
| 7,005,999 | B2 | | 2/2006 | Salzhauer et al. | |
| 7,038,590 | B2 | | 5/2006 | Hoffman et al. | |
| 7,228,429 | B2 | | 6/2007 | Monroe | |
| 7,289,036 | B2 | | 10/2007 | Salzhauer et al. | |
| 2007/0194048 | A1 | * | 8/2007 | Teig | 222/113 |
| 2008/0211677 | A1 | * | 9/2008 | Shecter | 340/573.1 |

OTHER PUBLICATIONS

Streetwise, Personal Door Alarm with Light, Dec. 15, 2007, http://www.nonlethaldefense.com/pedoalwilifr.html.

* cited by examiner

*Primary Examiner* — Jennifer Mehmood
*Assistant Examiner* — Brian Wilson
(74) *Attorney, Agent, or Firm* — Kyle Fletcher

(57) ABSTRACT

The invention is a key chain holder with clock and audible alarm. The invention includes a housing that contains the alarm, which is actuated by a spring-loaded trigger. The spring-loaded trigger requires at least 5 pounds of pressure in order to set off the alarm. The invention also includes a hand strap and flash light. The clock displays the time and date.

12 Claims, 3 Drawing Sheets

KEY CHAIN HOLDER WITH CLOCK AND ALARM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of keychain holders, more specifically, a key chain holder with multiple features including a clock and an alarm.

B. Discussion of the Prior Art

As a preliminary note, it should be stated that there is an ample amount of prior art that deals with key chain holders. As will be discussed immediately below, no prior art discloses a key chain holder that includes an alarm and a clock.

The Monroe Patent (U.S. Pat. No. 7,228,429) discloses a battery powered multimedia network appliance for security and surveillance applications including a personal alarm device, a conventional clock display, a strobe light, and a keypad mortise lock. However, the appliance is not directed to a keychain holder.

The Salzhauer et al. Patent (U.S. Pat. No. 7,289,036) discloses a battery powered personal alarm device having an integral wristband. However, the personal alarm device does not include a keychain holder.

The Hoffman et al. Patent (U.S. Pat. No. 7,038,590) discloses a personal security and tracking system. However, the tracking system does not involve a keychain holder.

The Salzhauer et al. Patent (U.S. Pat. No. 7,005,999) discloses a personal monitoring system that includes a messaging system, flash light, and audible alarm. However, the personal monitoring system is not designed for use with a keychain holder.

The Hodgen Patent (U.S. Pat. No. 6,980,105) discloses a personal alarm system including a key ring, a horn, and built-in flash light with flash button. However, the alarm system requires a transmitter, and does not have a spring-loaded trigger that activates an audible alarm, and also does not include a clock.

The Hess Patent (U.S. Pat. No. 6,441,731) discloses a portable alarm system that includes, among other things, a siren; but does not include a clock or a trigger.

The Olson Patent (U.S. Pat. No. 6,239,704) discloses a personal alarm system having actuator pin activation means. However, the pin actuation means of the alarm system is triggered upon movement of the individual being monitored with respect to a stationary object. The design of the personal alarm system is not designated for use with a keychain in order to be intentionally activated by the end user.

The Delmonaco Patent (U.S. Pat. No. 6,052,052) discloses a personal alarm system wherein the device provides a silent alarm by communicating with a standard communication system. The alarm system does not involve a keychain holder, a clock, or an audible alarm that is activated by a spring-loaded trigger.

The Personal Door Alarm with Light from Streetwise, a non-patent piece of prior art, discloses a personal alarm that involves a device that attaches via a clip and a cord is pulled to sound an audible alarm. However, the actuating means do not involve a spring-loaded trigger that is contained upon the housing along with a keychain holder and clock.

While the above-described devices fulfill their respective and particular objects and requirements, they do not describe a key chain holder with clock and alarm that provides for the advantages of the key chain holder with clock and alarm. In this regard, the key chain holder with clock and alarm departs from the conventional concepts and designs of the prior art.

SUMMARY OF THE INVENTION

The invention is a key chain holder with clock and audible alarm. The invention includes a housing that contains the alarm, which is actuated by a spring-loaded trigger. The spring-loaded trigger requires at least 5 pounds of pressure in order to set off the alarm. The invention also includes a hand strap and flash light. The clock displays the time and date.

An object of the invention is to provide a keychain holder with an audible alarm that is set off via a spring-loaded trigger.

A further object of the invention is to provide a keychain holder that includes a flashlight.

A further object of the invention is to provide a keychain holder that includes a clock.

A further object of the invention is to provide a spring-loaded trigger that requires enough pressure to set off the alarm and not minimal amount of pressure that may accidentally set off the alarm.

These together with additional objects, features and advantages of the keychain with clock and alarm will be readily apparent to those of ordinary skill in the art upon reading the following detailed description of presently preferred, but nonetheless illustrative, embodiments of the keychain with clock and alarm when taken in conjunction with the accompanying drawings.

In this respect, before explaining the current embodiments of the keychain with clock and alarm in detail, it is to be understood that the keychain with clock and alarm is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the keychain with clock and alarm. It is therefore important that the claims be regarded as including such equivalent construction insofar as they do not depart from the spirit and scope of the keychain with clock and alarm. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
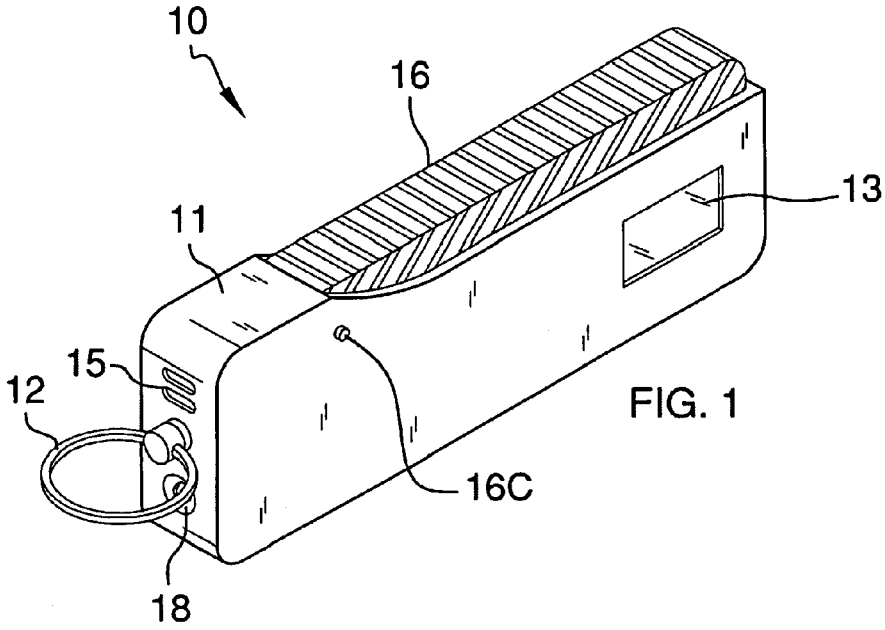
FIG. 1 illustrates an isometric front view of the invention.
Figure 2:
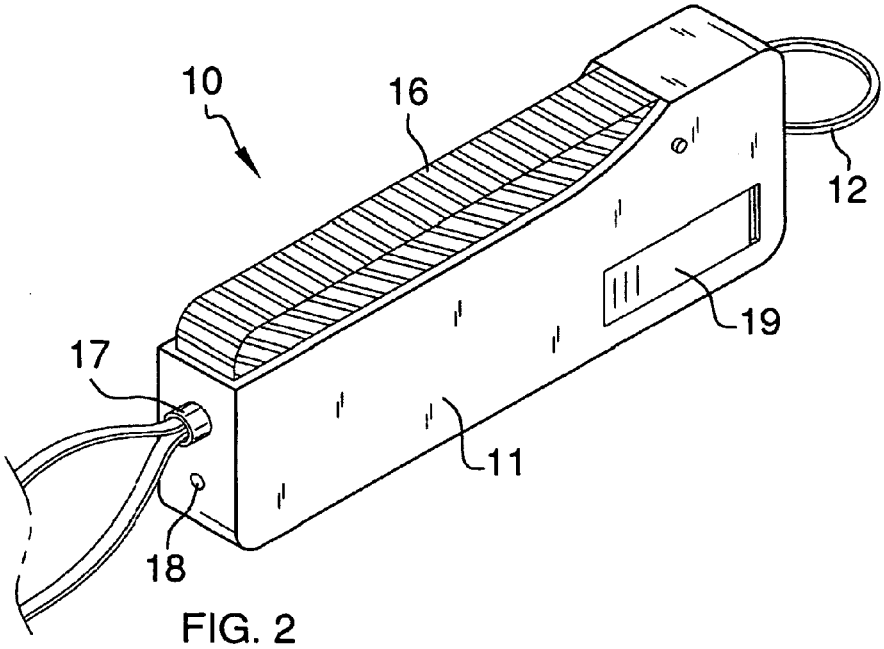
FIG. 2 illustrates an isometric rear view of the invention.
Figure 3:
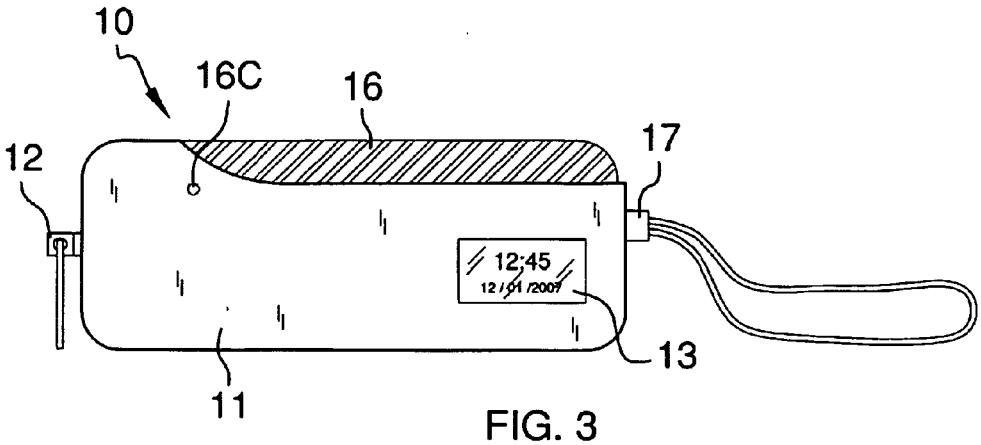
FIG. 3 illustrates a side view of the invention.

Detailed reference will now be made to the self-installing embodiment of the invention, examples of which are illustrated in FIGS. 1-6. An invention 10 includes a housing 11, a keychain holder 12, a clock 13, a central processing unit (hereinafter CPU) 14, an alarm 15, a trigger 16, a hand strap 17, a flash light 18, and a battery compartment 19.

The keychain holder 12 may have a quick-coupler means (not shown) such that the keychain holder 12 may separate from the housing 11. Also, please note that the hand strap 17 and the keychain holder 12 may be connected via a strap (not shown) that runs within the housing 11. The strap (not shown) would ensure that the hand strap 17 does not break from the key chain holder 12, much less the housing 11.

The CPU 14 is connected to the clock 13, the alarm 15, and a plurality of batteries 19A that are accessible via the battery compartment 19. It shall be noted that other powering means may be employed and include an array of solar cells. It shall be noted that the alarm 15 and the clock 13 may be connected to the batteries 19A directly and no CPU 14 be used in order to further simplify the invention 10.

Figure 4:
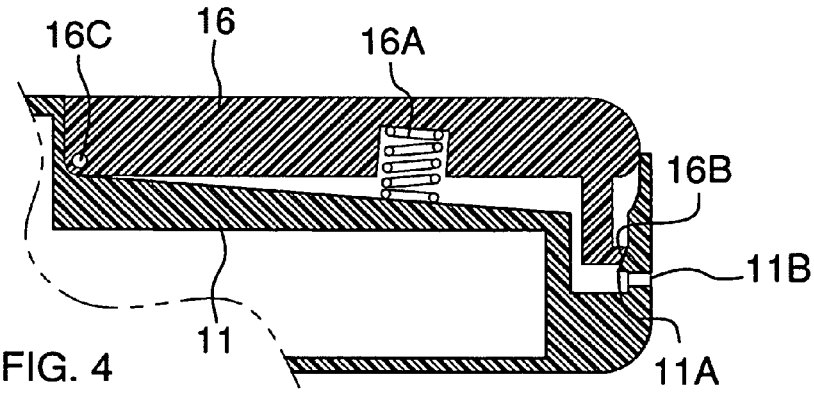
FIG. 4 illustrates a cross-sectional view of the trigger in the unlocked state.
Figure 5:
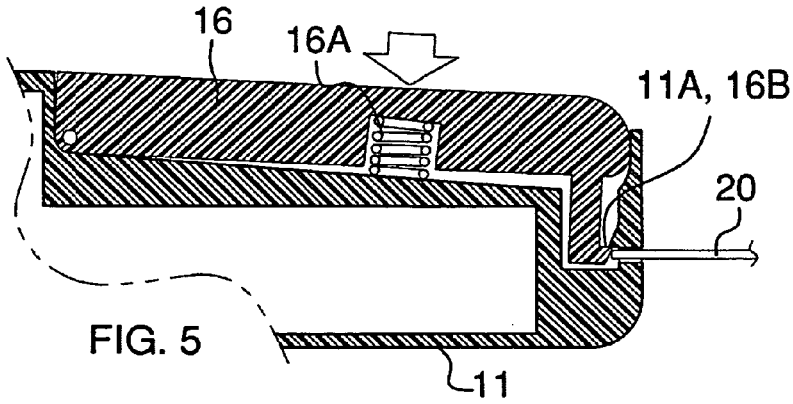
FIG. 5 illustrates a cross-sectional view of the trigger in the locked state.
Figure 6:
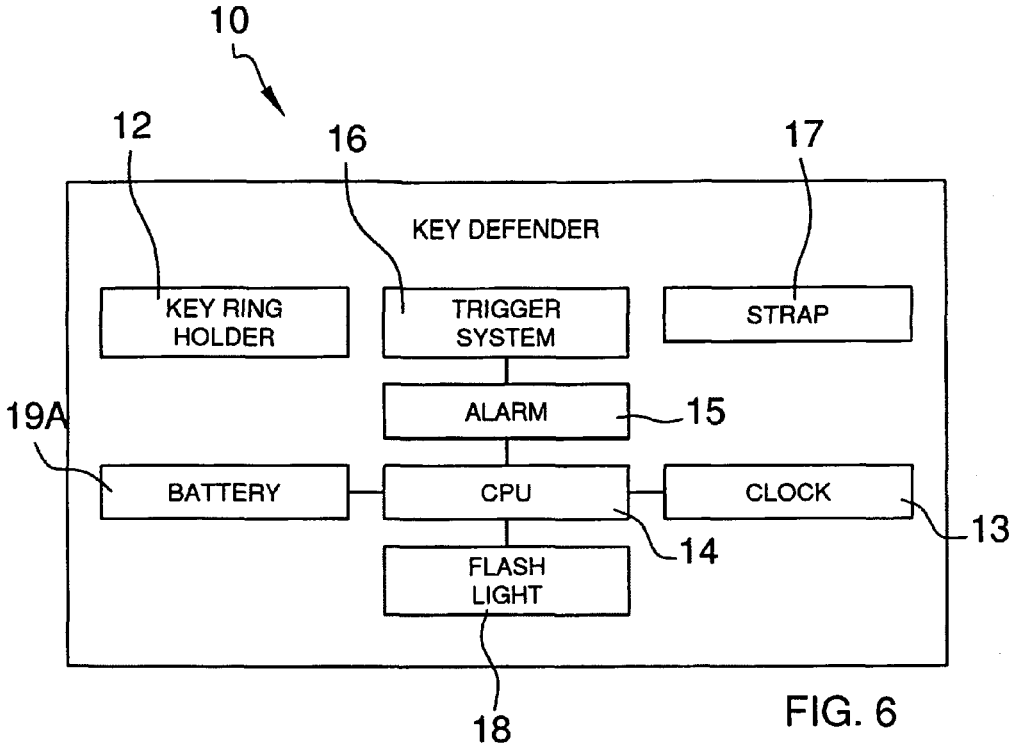
FIG. 6 illustrates a power diagram of the various electrical as well as non-electrical components of the invention.

Detailed reference will now be made to the trigger 16 by referring to FIGS. 4 and 5. The trigger 16 includes a spring 16A, a locking notch 16B, and a pivoting pin 16C. The housing 11 has a locking groove 11A and pin hole 11B. The trigger 16 operates by being depressed via the pivoting pin 16C and the spring 16A, until the locking notch 16B locks with the locking groove 11A, and shall be referred to as the locked state. The trigger 16 shall become unlocked by inserting a pin 20 into the pin hole 11B to disengage the locking notch 16B from the locking groove 11A.

It shall be noted that the spring 16A shall have a minimal level of resistance of 5 pounds in order to prevent the unwanted depression of the trigger 16. However, it shall be further noted that the spring 16A shall not have a level of resistance greater than 15 pounds.

The flash light 18 shall be located on a surface of the housing 11 that is adjacent with the keychain holder 12.

The housing 11 is made of a material comprising plastic, metal, or wood.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

Variations and alternatives of the present embodiment including equivalent structures and structural equivalents are readily apparent to those of ordinary skill in the art upon reading the present disclosure, and such variations and alternatives are incorporated in the invention unless otherwise expressly indicated in the claims.

The inventor claims:

1. A key chain holder with clock and audible alarm comprising:
- (a) a key chain holder;
- (b) a clock;
- (c) an audible alarm;
  - wherein the audible alarm is set off by a trigger;
  - wherein the trigger is spring-loaded, and requires at least five pounds of pressure in order to set off the audible alarm;
  - wherein upon depression of the trigger, the audible alarm is set off, and the trigger is locked;
  - wherein the trigger includes a spring, a locking notch, and a pivoting pin;
  - a housing has a locking groove and pin hole;
  - wherein the trigger operates by being depressed via the pivoting pin and the spring, until the locking notch locks with the locking groove;
  - wherein the trigger shall become unlocked by inserting a pin into the pin hole to disengage the locking notch from the locking groove.

2. The key chain holder with clock and audible alarm as described in claim 1 wherein a flash light is included and directs light in the general direction as of the keychain.

3. The key chain holder with clock and audible alarm as described in claim 2 wherein a battery provides electrical power to the clock and the audible alarm.

4. The key chain holder with clock and audible alarm as described in claim 2 wherein a plurality of batteries provide electrical power to the clock and the audible alarm.

5. The key chain holder with clock and audible alarm as described in claim 2 that includes a hand strap.

6. A key chain holder with clock and audible alarm comprising:
- (a) a key chain holder;
- (b) a central processing unit (hereinafter CPU);
- (c) a clock;
  - wherein the clock is connected to the CPU;
- (d) an audible alarm;
  - wherein the audible alarm is connected to the CPU;
  - wherein the audible alarm is set off by a trigger;
  - wherein the trigger is spring-loaded, and requires at least five pounds of pressure in order to set off the audible alarm;
  - wherein the trigger includes a spring, a locking notch, and a pivoting pin;
  - a housing has a locking groove and pin hole;
  - wherein the trigger operates by being depressed via the pivoting pin and the spring, until the locking notch locks with the locking groove;
  - wherein the trigger shall become unlocked by inserting a pin into the pin hole to disengage the locking notch from the locking groove.

7. The key chain holder with clock and audible alarm as described in claim 6 wherein a flash light is included and directs light in the general direction of the keychain.

8. The key chain holder with clock and audible alarm as described in claim 7 wherein a battery provides electrical power to the clock and the audible alarm.

9. The key chain holder with clock and audible alarm as described in claim 7 wherein a plurality of batteries provide electrical power to the clock and the audible alarm.

10. The key chain holder with clock and audible alarm as described in claim 7 that includes a hand strap.

11. A key chain holder with clock and audible alarm comprising:
- a key chain holder;
- a central processing unit (hereinafter CPU);
- a clock connected to the CPU;
- an audible alarm connected to the CPU, and is set off by a trigger;
- wherein the trigger is spring-loaded, and requires at least five pounds of pressure in order to set off the audible alarm;

wherein the trigger includes a spring, a locking notch, and a pivoting pin;

a housing has a locking groove and pin hole;

wherein the trigger operates by being depressed via the pivoting pan and the spring, until the locking notch locks with the locking groove;

wherein the trigger shall become unlocked by inserting a pin into the pin hole to disengage the locking notch from the locking groove;

wherein a flash light is included and directs light in the general direction of the keychain;

wherein a strap extends from the housing on a side opposite of the key chain holder.

12. The key chain holder with clock and audible alarm as described in claim 11 wherein at least one battery provides electrical power to the clock and the audible alarm.

* * * * *